United States Patent [19]

Claude

[11] Patent Number: 5,003,632

[45] Date of Patent: Apr. 2, 1991

[54] DEVICE FOR CONNECTING A BREATHING MASK TO A HELMET

[75] Inventor: Jacques Claude, Fresnes, France

[73] Assignee: Intertechnique, France

[21] Appl. No.: 334,509

[22] Filed: Apr. 7, 1989

[30] Foreign Application Priority Data

Apr. 7, 1988 [FR] France ..... 88 04616

[51] Int. Cl.[5] ..... A42B 3/00

[52] U.S. Cl. ..... 2/6; 2/421; 2/424; 128/201.24; 128/202.27

[58] Field of Search ..... 2/6, 424, 422, 421; 128/201.24, 201.23, 201.22, 202.27

[56] References Cited

U.S. PATENT DOCUMENTS 2,715,222 8/1955 Sowle ..... 2/424 X
2,942,602 6/1960 Seeler ..... 128/201.23
3,065,747 11/1962 Forkel ..... 128/201.24
4,555,815 12/1985 Walther ..... 2/424
4,734,940 4/1988 Galet et al. ..... 2/6 X

*Primary Examiner*—Peter Nerbun
*Attorney, Agent, or Firm*—Larson and Taylor

[57] ABSTRACT

The device is for connecting the shell or face piece of an oral nasal breathing mask of a fighter pilot to a helmet. It comprises two fasteners each placed on one side of a median vertical plane of the helmet and one at least of which is provided with a quick fastening and unfastening attachment device. Each fastener is formed as a link rigid in the vertical direction and non-extensible, arranged to allow rotational movement of the mask with respect to the helmet about a direction perpendicular to the direction of the link and substantially parallel to said median vertical plane.

12 Claims, 2 Drawing Sheets

DEVICE FOR CONNECTING A BREATHING MASK TO A HELMET

BACKGROUND OF THE INVENTION

1. Technical Field

The invention relates to devices for connecting the shell or face piece of an oral-nasal breathing mask to a helmet of the type comprising two fasteners, each placed on one side of the median vertical plane of the helmet and one at least of which is provided with a quick fastening and unfastening attachment device.

2. Prior Art

Devices of the above defined kind are very widely used in military aeronautics, for connecting the breathing mask required for high altitude flights to the helmet worn by the crew members. In known devices, such as those described in the documents US-A-3 035 573 and GB-A-894 747, the fasteners comprise a continuous strap passing over the shell of the face cover of the mask at a relatively high level. The shell of the mask is arranged for fitting over the chin and a second strap for connection to the helmet passes under the mask so as to retain it, particularly in the case of bailing out.

This arrangement has been very likely adopted, almost universaly in present day fighter aircraft, because it was thought necessary for fitting the mask sufficiently sealingly against the face of the wearer. But it has therefore drawbacks, the seriousness of which seems not to have been appreciated up to now. Due to the deformable nature of the straps, there is a danger of leaks appearing between the face and the shell when the mask is fed at a high overpressure with respect to the ambient atmosphere. When the pilot is subjected to high accelerations, there is a danger of the mask slipping downwards. The strap, which is placed very high, impairs the downward vision field of the wearer. Furthermore, it is known that one of the problems impeding use of a helmet aiming unit is the danger of the helmet moving during movements of the head, the presence of the mask being unable to prevent such sliding due to the flexibility of the straps.

SUMMARY OF THE INVENTION

An object of the invention is to provide a mask connecting device which better fulfils the requirements of practice than those previously known, particularly in that it improves holding of the mask on the face, particularly upon a high breathing overpressure or a sudden acceleration and better sealing.

For this, the invention provides more particularly a device of the above defined type, in which each fastener is formed as a link rigid in the vertical direction and not extensible, allowing a relative rotational movement of the mask with respect to the helmet about a direction perpendicular to the direction of the link and substantially parallel to the plane of symmetry of the wearer's face.

For sealed application of the face cover on the face, an additional degree of adjustement or freedom will be provided, at least when the helmet and the mask are custom made, i.e. intended to be worn by a single person. A simple approach, which may also be adopted even in the case of full custom made equipment, consists in fixing the link on the shell by means making it possible for the mask to rotate about an additional axis, substantially orthogonal to the shell. When the helmet is likely to be worn by different persons, means for vertically adjusting the fastening point to the helmet will generally be provided.

It is possible to allow the mask to rotate about an axis perpendicular to the direction of the link in different ways. In a first embodiment, the link is formed as a resiliently flexible blade, so as to be able to bend transversaly. In a second embodiment, the link is rigid, but pivotally mounted at its end about two axes which are substantially parallel to each other and parallel to the plan of symetry of the face.

Although it is sufficient for one of the fasteners to be provided with a quick fastening and unfastening connection device, it will generally be more advantageous to provide such a member for each of the links, and in addition to form the member so that it allows ready adjustment of the mechanical pressure of applying the mask against the face. It will generally be particularly advantageous to use a connection member of the kind described in document US-A- 4,577,375. In this case, adjustement for fitting the device to a particular wearer may be provided by mounting the receptacle of the member on the helmet not rigidly, but on a vertical slide.

So that the connection member retains all its adjustment capacity whatever the helmet on which the mask is fitted, it may be advantageous to provide the device so that the links are replaceable, different lengths of links being then possibly provided. Another solution consists in providing links of adjustable length.

The device of the invention provides numerous advantages : the danger of the mask sliding down upon occurence of a high acceleration is overcome due to the rigidity of the links which then are subjected to flexure stresses in the direction of high rigidity. Sealing of the mask is maintained even in the case of a high breathing overpressure, because the links are inextensible. Positioning of the mask is facilitated due to the rigidity of the fasteners which means that the mask will always be positioned in the same way when the connection member or members are operated. The visual field is increased : in fact, the links will generally be connected to the shell much lower than the usual straps, which is a lesser hindrance to vision and also makes it possible to lower a possible sight piece to a greater extent. Finally, because the mask and the helmet form a rigid assembly once they are fixed together, the mask participates in holding the helmet in an immovable position with respect to the head (the fact that the mask bears against the edge of the nose retains the helmet in position when the head is rotated) and increases the accuracy of a possible helmet sight.

The invention will be better understood from the following description of particular embodiments, given by way of non limitative examples. The description refers to the accompanying drawings.

DETAILED DESCRIPTION OF PREFERRED EMBODIMENTS

Figure 1:
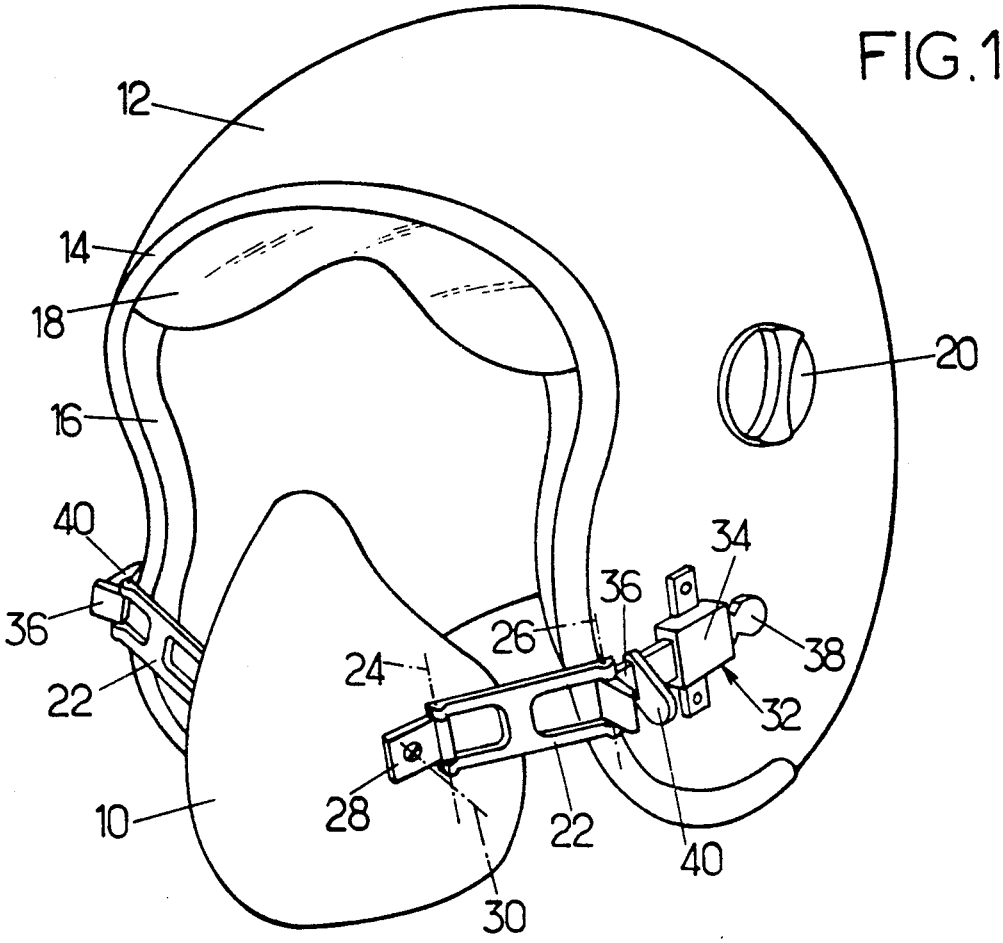
FIG. 1 is a simplified view showing a helmet and the shell of a mask in accordance with the invention connected to the helmet by a device according to a first embodiment thereof.

The device shown schematically in FIG. 1 is intended for fastening the shell 10 of a breathing mask to the rigid shell 12 of a pilot's helmet. The helmet as shown has a conventional construction: it comprises inside a shell 12 provided with padding 14, a cap 16 intended to be applied onto the skull of the wearer. A visor 18 is movable, by swinging it under control of handles 20 between a top position in which it is shown at 18 in FIG. 1 and a low position in which it comes against the shell 10.

The connecting device of the invention comprises two fasteners disposed symetrically with respect to the vertical median plane of the shell of the mask. In the case illustrated in FIG. 1, each fastener comprises a link 22 rigid when subjected to flexure forces in a vertical plane, not extensible and articulated to the shell 10 of the mask and to the helmet about two axes 24 and 26 substantially parallel to the median plane and perpendicular to the length of the links. These two pins may be not exactly parallel if the link is twisted for taking into account the flaring shape of the shell of the face cover. For this reason, one end of the link is connected by a pin to a connector 28. In the embodiment shown, connector 28 so fastened to shell 10, for example by means of a rivet, as to be able to rotate about an axis 30 perpendicular to axis 24 and directed towards the median plane. The other end of the link is articulated about pin 26 on a component of a quick insertion and removal connection unit 32.

Unit 32 may typically be of the type described in document US-A-4 575 375. The unit then comprises a receptacle 34 fixed rigidly to shell 12 of the helmet and an assembly insertable into the receptacle. The link is pivotably connected about axis 26 on a bayonet 36 belonging, with a control blade 38, to the assembly. Bayonet 36 comprises a double rack arranged for being inserted into receptacle 34 by simply pushing it and allowing step by step adjustement. It may only be withdrawn by pulling on a flange 40 of the control blade 38.

It can be seen that the links are connected to the shell 10 of the mask ar a level which is approximately that at which pressure forces are applied which tend to raise the mask if there is an overpressure inside. Consequently, in some cases, it will be useless to provide a strap connecting the bottom of the shell to the helmet. It will also be possible in some cases to use a shell terminating short of the chin, rather than enclosing it.

The link 22 shown in FIG. 1 is in the form of a plate, hollowed out to form a double fork for rendering it lighter. This construction is not the only possible one and others will now be described as additional examples.

Figure 2:
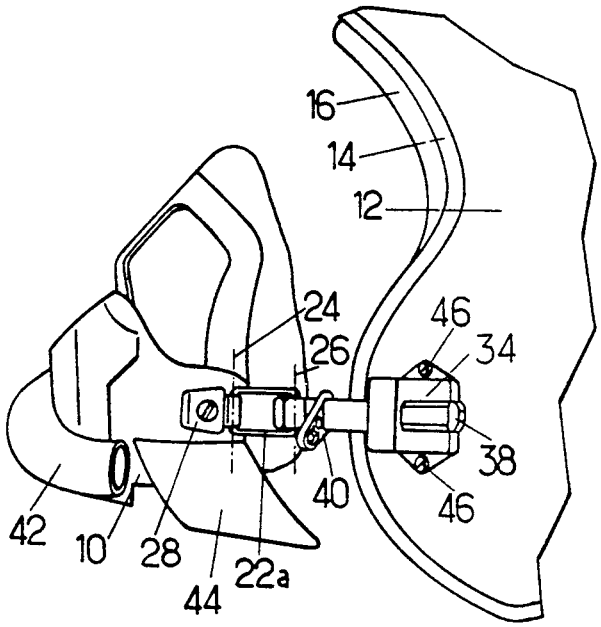
FIG. 2 is an elevation of view showing a mask connected by a device according to a modified construction to a helmet, only a fraction of which is shown.

The embodiment shown in FIG. 2 (in which the members correspondant to those of FIG. 1 are designated by the same reference member) again comprises a mask shell 10, connected to the hose 42 for feeding breathing mixture and having a chin strap 44. Link **22*a* is formed as a rectangular ring. The quick insertion and removal connection unit again comprises an insertable assembly connected to link 22*a* for pivotal movement about axis 26 and a receptacle 34 fixed to the shell of the helmet by two screws 46**.

Figure 3:
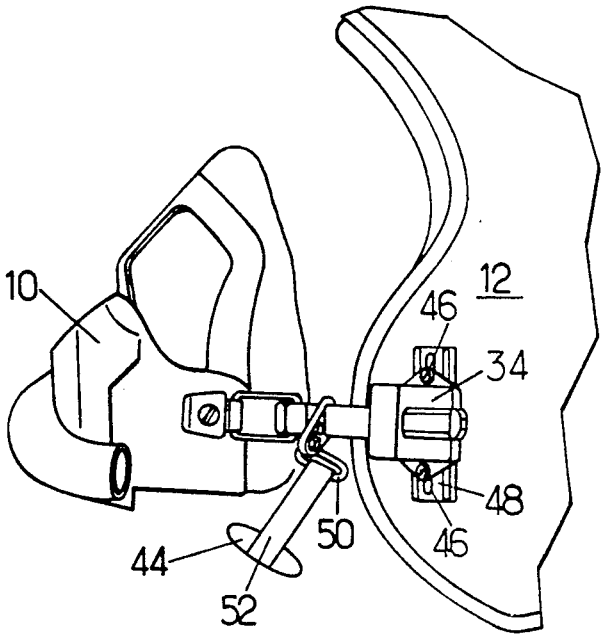
FIG. 3, similar to FIG. 2, shows yet another modification.
Figure 4:
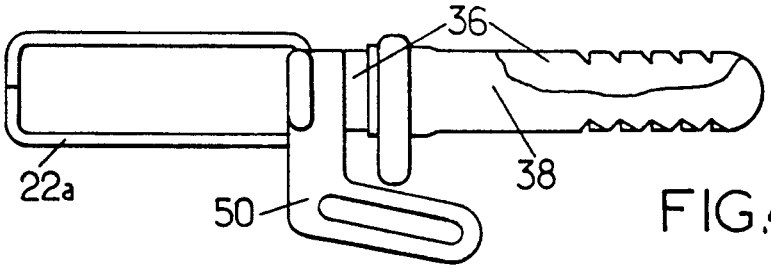
FIG. 4 is an enlarged detail view showing the construction of the link of FIG. 3 and of the part of the connection member which is fastened thereto.

The embodiment shown in FIG. 3 differs from the preceding one in two aspects.

Receptacle 34, instead of being fixed directly to helmet 12 is mounted on a vertical slide 48. Two screws 46 carried by the receptacle pass through elongated holes in the slide and engage in internally threaded holes in a clamping plate, thus making it possible to adjust the vertical position of the receptacle as a function of the morphology of the individual who is to wear the helmet and the mask. Bayonet 36 is provided with a loop 50 receiving a strap 52 for holding a chin strap 44 in position, the mask then terminating above the chin.

In yet another embodiment (not shown), the mask covers only the mouth and the nose and strap 52 is connected to a separate chin strap fast with the helmet and preventing it from raising when there is a vertical downward acceleration.

Figure 5:
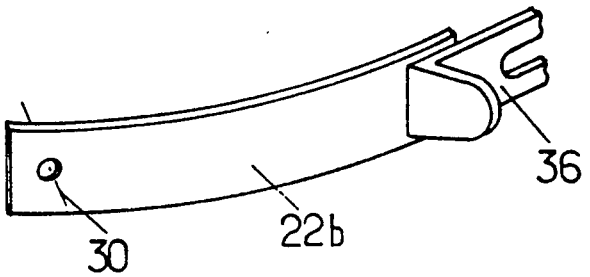
FIG. 5 shows schematically another possible construction of the link of the device of the invention.

Finally, FIG. 5 shows a link **22*b* formed by a flexible blade, typically of metal, intended to be fixed on the mask by a rivet or a screw leaving it free to rotate about the axis 30 and to be fixed rigidly or via a pin to bayonet 36. Then, the role of the two axis 24 and 26 of the preceding embodiments is fulfilled by the lateral flexibility of blade 22*b***, which must again remain rigid in the vertical direction.

Figure 6:
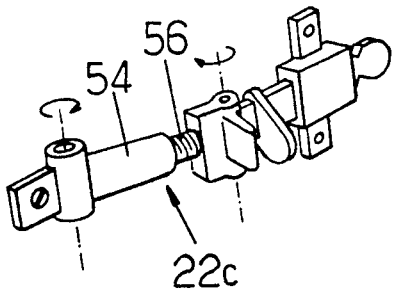
FIG. 6 shows schematically a construction of a device forming yet another embodiment.

In the modification shown in FIG. 6 in which the mask and the helmet have not been shown, link **22*c* is of adjustable length. For that, it comprises a female part 54 pierced with a tapped hole in which is screwed a threaded rod 56**, provided on the other part. This arrangement is particularly advantageous when the mask is to be fitted to helmets of different sizes: by giving the link a suitable length, the adjustment bayonet may be fitted half-way in the normal conditions of use, thus leaving an appreciable latitude of adjustment. Instead of using a threaded rod and tapped hole system, the link may be formed of two blades sliding on each other and fixed in different positions.

I claim:

1. A device for connecting a shell of a breathing mask to a helmet, comprising two fasteners each placed on one of a median vertical plane of the helmet and each having:

a quick fastening and unfastening attachment unit including a receptacle fixed rigidly to the helmet and an assembly insertable into and positively releasibly lockable in said receptacle in an adjustable position, and a link constructed to resist vertically directed flexure forces and nonextensible, one of the end portions of the link being permanently connected to the shell by first pivotal connection means allowing rotational movement of the mask with respect to the link about a first axis perpendicular to the direction of the link and substantially parallel to said median vertical plane and the other end portion of the link being permanently connected to said assembly by second pivotal connection means allowing rotational movement of the link with respect to the attachment unit about a second axis substantially parallel to said first axis.

2. Device according to claim 1, wherein each of said links is rigid.

3. Device according to claim 2, wherein each of said links consists of a plate shaped to constitute a double fork.

4. Device according to claim 1, wherein each link is connected to the mask by means allowing the mask to rotate about a supplementary axis which is substantially perpendicular to the shell and to the first axis.

5. Device according to claim 1, wherein said receptable of said quick fastening and unfastening attachment unit has connecting means arranged for vertically adjusting a point of permanent attachment thereof on said helmet.

6. Device according to claim 1, wherein said links are connected to the shell at a horizontal level which is approximately identical to the level at which pressure forces are applied which tend to lift the mask when there is an overpressure inside the mask.

7. Device according to claim 1, wherein each of the said links has a loop for receiving a strap for a chin housing.

8. Device according to claim 1, wherein said links have an adjustable length.

9. Device according to claim 1, wherein said links are removable for replacement.

10. Device according to claim 1, wherein each of said links consists of a rectangular shaped ring and wherein each of said pivotal connection means includes one of two mutually parallel sides of the ring, respectively received in said assembly and in a connector permanently connected to the mask by means allowing the mask to rotate with respect to the link about a supplementary axis which is substantially perpendicular to the shell and to the first axis.

11. A device for connecting a shell of a breathing mask to a helmet, comprising two fasteners each placed on one side of a median vertical plane of the helmet and each having:

a quick fastening and unfastening attachment unit including a receptacle fixed rigidly to the helmet and a positioning assembly positively lockable in said receptacle, said position assembly having a rack for step-by-step adjustment of said assembly in said receptacle and having means for manually releasing said assembly, and a non-extensible link constructed to resist vertically directed flexure forces and arranged to allow rotational movement of the mask with respect to the helmet about a first axis perpendicular to the direction of the link and substantially parallel to said median vertical plane, one of the end portions of the link being permanently connected to the assembly and the other end portion of the link being permanently connected to the shell by pivotal connection means allowing rotational movement of the link with respect to the shell about an axis substantially orthogonal to said first axis.

12. Device according to claim 11, wherein each of said links consists of a blade which is resiliently deformable when subjected to transversal flexure forces and rigid in the vertical direction.

* * * * *